United States Patent [19]

Chalmers et al.

[11] 4,288,958

[45] Sep. 15, 1981

[54] HORIZONTAL SIDING PANEL SYSTEM WITH VERTICAL STRINGERS

[75] Inventors: Alexander A. Chalmers, Warren; J. Lynn Gailey, Newton Falls, both of Ohio

[73] Assignee: Alcan Aluminum Corporation, Cleveland, Ohio

[21] Appl. No.: 49,850

[22] Filed: Jun. 18, 1979

[51] Int. Cl.[3] ..... E04D 1/06; E04D 3/362

[52] U.S. Cl. ..... 52/478; 52/551; 52/712; 52/520

[58] Field of Search ..... 52/521, 520, 530, 531, 52/529, 519, 545, 551, 478, 712

[56] References Cited

U.S. PATENT DOCUMENTS

| | | | |
|---|---|---|---|
| 1,072,825 | 9/1913 | Clemmer | 52/531 |
| 3,131,513 | 5/1964 | Grigas | 52/520 |
| 3,236,932 | 2/1966 | Grigas | 52/551 |
| 3,394,520 | 7/1968 | Skelton | 52/521 |

*Primary Examiner*—John E. Murtagh

*Attorney, Agent, or Firm*—Cooper, Dunham, Clark, Griffin & Moran

[57] ABSTRACT

An array of overlapped, interlocking horizontal siding panels secured to a wall by parallel vertical stringers having vertically spaced resilient clips for holding the top margins of the panels, wherein the panel top margins and stringer clips cooperatively provide a double locking arrangement such that as a panel is mounted on the stringers, it is moved into a first position in which its top margin engages clips of the stringers and then is moved upwardly into a second position in which it simultaneously further engages the clips and interlocks with the next lower panel in the array. To this end, the top margin of each panel has a locking projection above the conventional lip provided for interlocking with the bottom margin of the adjacent higher panel, and each clip has two vertically spaced locking surfaces for successively engaging this locking projection as the panel top margin is pushed upwardly under the clip. In some embodiments, each panel also has a central flange projecting inwardly and upwardly for engagement with retaining tabs formed in the stringers.

13 Claims, 7 Drawing Figures

Fig. 6.
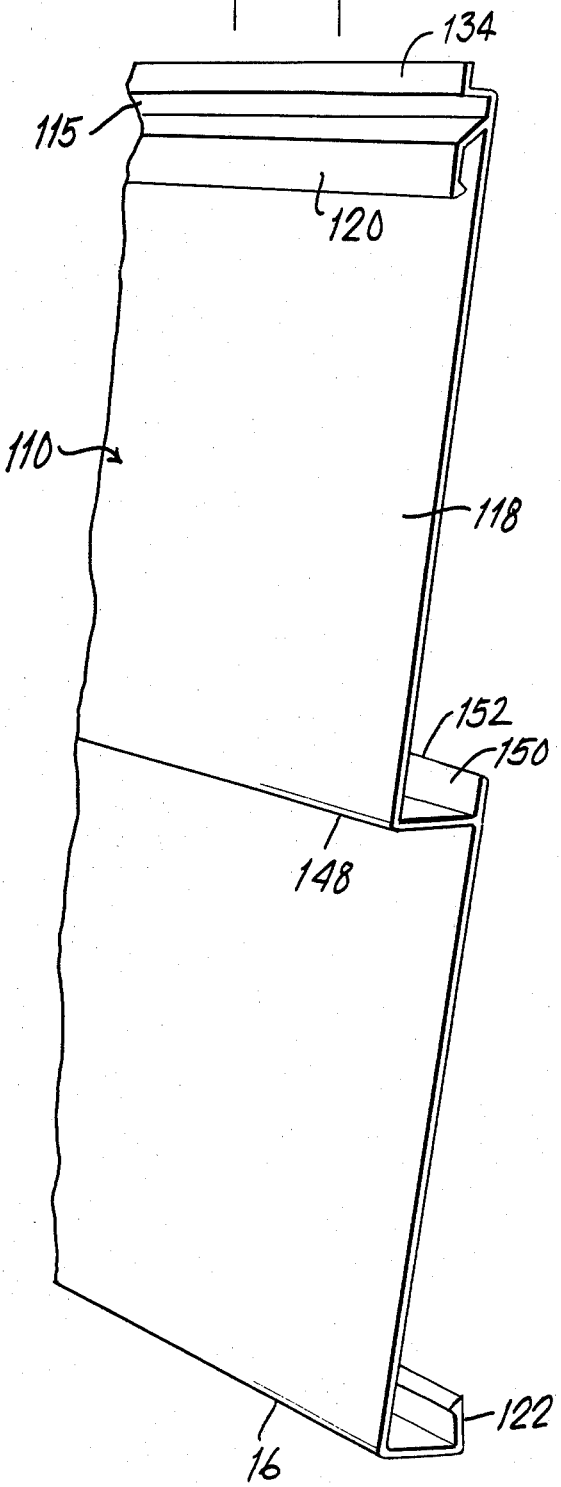
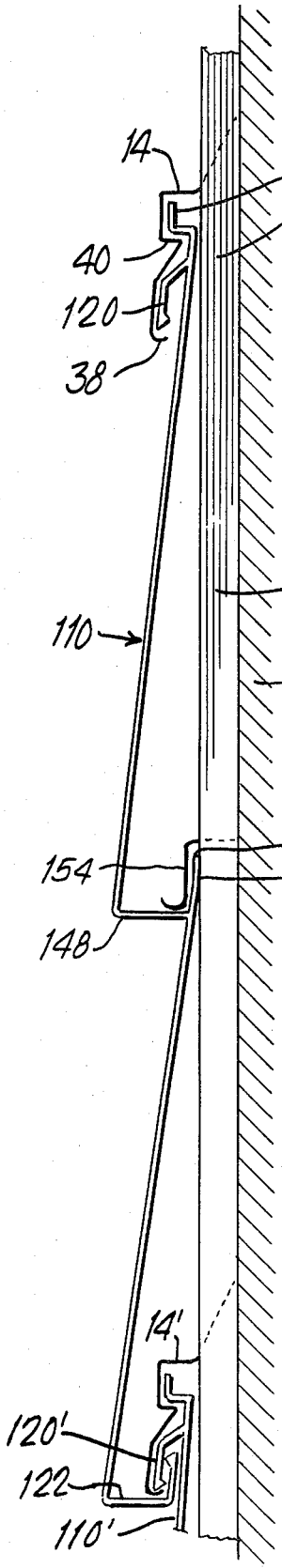
Fig. 7.

HORIZONTAL SIDING PANEL SYSTEM WITH VERTICAL STRINGERS

BACKGROUND OF THE INVENTION

This invention relates to lapped multiplanar surfacing for structures such as buildings, and in particular to lapped multiplanar surfacing having interfitted sections with fastener or anchor strips each securing plural sections at the junctures between sections. Specifically, the invention is directed to horizontal siding panel systems having vertical stringers with resilient clips for securing the panels to a wall or the like.

Horizontally elongated siding panels such as roll-formed sheet metal (e.g. aluminum) panels or molded plastic (e.g. vinyl) panels are widely employed for cladding exterior walls of buildings. Typically, the panels are mounted one above another on a wall in parallel, overlapping, interlocked relation with the surface of each panel sloping downwardly and outwardly so as to simulate the appearance of clapboards or other conventional wooden siding, and are attached to the wall at their top margins by suitable fasteners. Each panel has an outwardly projecting lip along its top margin, and an inwardly bent, upwardly opening channel flange at its bottom margin for overlying and interlocking with the lip of the next lower panel on the wall to secure the panel bottom edge (with the panel surface spaced from the surface of the lower panel) and to conceal the fasteners that hold the lower panel.

It will be understood that terms such as "inner" or "inwardly" and "outer" or "outwardly" herein designate directions respectively toward and away from the wall on which a panel is mounted, and that these terms, as well as terms such as "upper" or "top" and "lower" or "bottom," are used with reference to the orientation of a panel when mounted on a wall with the long dimension of the panel extending horizontally; also, that "wall" includes sloping surfaces such as roofs as well as vertical wall surfaces.

Siding panels of the type described above have conventionally been secured to walls by fasteners such as nails driven through a flat nailing flange (which may have prepunched nail holes) provided at the panel top margin above the locking lip, or alternatively by plural small individual resilient clips which engage the locking lips of the panels and are nailed or otherwise fastened on the wall. These mounting arrangements are disadvantageous in that it is difficult to achieve proper positioning and alignment of the successive courses of panels, especially when installation is being performed by homeowners without experience or special equipment.

Accordingly, vertical stringers have been devised to facilitate mounting of horizontal siding panels. A typical commercially available vertical stringer for this purpose is a vertically elongated roll-formed thin metal strip having a plurality of preformed integral resilient clips, opening downwardly, located at vertically spaced intervals along its length. The clips are produced by striking out portions of the central web of the metal strip and forming the struckout portions to a shape suitable for engaging and holding the locking lips of panels of the above-described type; the spacing between successive clips on a stringer is equal to the spacing between the lips of adjacent (lower and upper) panels when the panels are interlocked. In use, a plurality of these stringers are nailed or otherwise fastened side by side on a wall in vertically oriented, parallel, spaced relation (e.g. 16 inches or 24 inches apart on centers) with their respective clips horizontally aligned, i.e. with the lowermost clips of all the stringers lying in a first common horizontal line, the next higher clips of all the stringers lying in a second common horizontal line, and so forth, each stringer extending from the lower edge of the wall to the top of the wall. Alignment of the stringers is achieved by first mounting a conventional horizontal starter strip along the lower edge of the wall and then engaging the lowermost clip of each stringer with the starter strip before nailing the thus-aligned stringer to the wall in a vertical position. The panels are successively snapped into place on the stringers, beginning with the lowermost course of panels, by inserting the top margin and lip of a panel into a horizontal row of clips respectively formed on adjacent stringers while simultaneously fitting the bottom marginal flange of the panel over the lip of the next lower (already mounted) panel; each panel is held in place by at least two (usually several more than two) clips at the top and by interlocking with the next lower panel at the bottom. The preformed, regularly spaced clips assure that all the panels thus installed are properly positioned and aligned in the array of panels.

Nevertheless, currently available types of vertical stringers present other problems. Their design requires that the installer position the top locking lip and the bottom locking flange of a panel for simultaneously engagement respectively with a row of stringer clips and with the lip of the already-mounted next lower panel, while holding the panel in against the stringers and raising it into locking position. Owing to the complexity of this operation, the panel often fails to engage one or more of the stringer clips that are to hold it, and must then be removed from engagement with the rest of the clips before it can be repositioned for proper mounting; such removal is difficult and often distorts or otherwise damages at least some of the clips.

A further problem, encountered in use of vertical stringers with plastic siding panels, is that plastic panels sometimes tend to be less stably retained by clip and interlock arrangements than metal panels, owing to their relatively greater flexibility. Moreover, the central webs of plastic panels (between the lips and bottom flanges) tend to depart in varying degrees from true planar configuration. Although horizontal siding panels of the type herein considered are usually quite long (a representative example of panel dimensions being 12 feet 6 inches in horizontal length, and eight inches in exposed vertical height after installation), the length of many walls requires installation of two or more panels side by side in a single course; and where the butt ends of adjacent panels meet in the same course, differing degrees of distortion of their respective central webs produce an undesirable discontinuity in appearance.

SUMMARY OF THE INVENTION

The present invention broadly contemplates the provision of a siding system of the general type described above, comprising horizontally elongated, overlapping, interlocking panels and vertical stringers with resilient clips, in which the stringer clips and the top margins of the panels cooperatively provide a double-lock interengagement of the panels and clips such that a panel being installed is placed in a first position at which its top margin engages a row of the clips while the bottom margin of the panel is free, and is then moved up to a second position at which the top margin further engages the clips while the bottom margin interlocks with the next lower panel. This two-step operation is manipulatively easier than installation of a panel on a conventional vertical stringer; moreover, the double-lock arrangement enables the installer to check for proper engagement of the clips when the panel is at the first position, and to remove the panel therefrom (if necessary for repositioning of the panel, i.e. if one or more clips are not properly engaged) with a simple pivotal motion that involves virtually no risk of damage to the clips.

The panel of the present system can be a generally conventional horizontally elongated siding panel having an outwardly and downwardly projecting locking lip extending along its top margin and an inwardly bent, upwardly opening longitudinal channel flange at its bottom margin, with a broad central web extending between the lip and flange. As a first particular feature of the invention, however, the present panel differs from a conventional panel in having a longitudinal locking projection that protrudes outwardly at its top margin and is spaced above the conventional locking lip. This projection can be L-shaped in cross section, with the base of the L extending outwardly and the leg of the L extending perpendicularly upward from the outer extremity of the base.

Simlarly, the stringer of the present system can be a generally conventional vertical stringer comprising a vertically elongated thin metal strip with downwardly opening resilient clips struck out from its central web at regularly spaced intervals along its length, but (as another particular feature of the invention) it differs from a conventional stringer in that the inner surface of each clip is formed with two vertically spaced, generally upwardly facing locking sufaces or seats for successively engaging the locking projection of a panel as the panel top margin is pushed upwardly under the clip. The inner surface of the clip slopes inwardly and upwardly from the outward side of the lower locking seat to the inner edge of the upper locking seat to facilitate upward sliding motion of the panel locking projection (with concomitant resilient deformation of the clip) from the lower seat to the upper seat.

The spacing between the upper and lower locking seats of a clip is about equal to the spacing between the lowest points on the locking projection and lip, respectively, of a panel. The spacing between adjacent clips on a stringer is of such magnitude in relation to the panel dimensions that when the locking projection of a panel is in the lower locking seat of one clip and the panel depends downwardly therefrom, the bottom locking flange of the panel is entirely clear of the next lower clip on the stringer, and also clear of a panel lip within that lower clip; but when the panel is moved upwardly to insert the locking projection in the upper seat of the clip (the lower seat being then just below the panel lip), the bottom flange of the panel overlies and interlocks with the lip of a panel fully inserted in the next lower clip on the stringer, in surrounding and concealing relation to the latter clip.

The bottom edge of each clip of a stringer is spaced outwardly from the vertical plane of the main body of the stringer, and constitutes the inner edge of the lower locking seat of the clip. The locking projection on each panel is so dimensioned, in relation to the spacing between the inner surface of the clip above the lower locking seat and the last-mentioned vertical plane, as to permit the panel to pivot through a substantial angle about an axis substantially coincident with the clip bottom edge when the locking projection is received within the lower locking seat, and to permit the locking projection to be inserted under or withdrawn from the clip when the major surface of the panel is pivoted to a substantial angle to the vertical. Thus, in installation, the locking projection of a panel is initially inserted into the lower seats of a horizontal row of clips respectively formed on adjacent stringers, and the panel is pivoted downwardly and inwardly to a depending position, in which its bottom flange is clear of the lip of the next lower panel already mounted on the stringers. At this point, if necessary, the panel can still be easily removed by a reverse (outward) pivotal movement without damaging the clips; but assuming all the clips are properly engaged, the panel is simply pushed upwardly to insert its locking projection in the upper seats of the clips and concurrently to interlock its bottom flange with the lip of the next lower panel.

As still another feature of the invention, particularly applicable when molded plastic panels are used, an inwardly extending and upwardly opening horizontal channel can be provided on the inner surface of the panel, located about at the horizontal median of the panel central web, and a series of downwardly opening retaining tabs can be struck out from the central web of each stringer at locations, intermediate adjacent clips, such that when a panel is moved upwardly to engage its locking projection with the upper locking seats of a row of clips, the inner leg of this channel is inserted behind a corresponding row of these retaining tabs. This interlocking of the retaining tabs with the last-mentioned channel inner leg, which constitutes a supplemental locking flange, aids in retaining the panel on the stringers and also positionally stabilizes its central web so that facing ends of adjacent panels in the same course are flush with each other.

Further features and advantages of the invention will be apparent from the detailed description hereinbelow set forth, together with the accompanying drawings.

BRIEF DESCRIPTION OF THE DRAWINGS

FIG. 6 is a fragmentary perspective view of another embodiment of the panel of the invention; and FIG. 7 is a fragmentary side elevational view, similar to FIG. 5, showing the panel of FIG. 6 mounted on a stringer of the type shown in FIG. 1.

DETAILED DESCRIPTION

Figure 1:
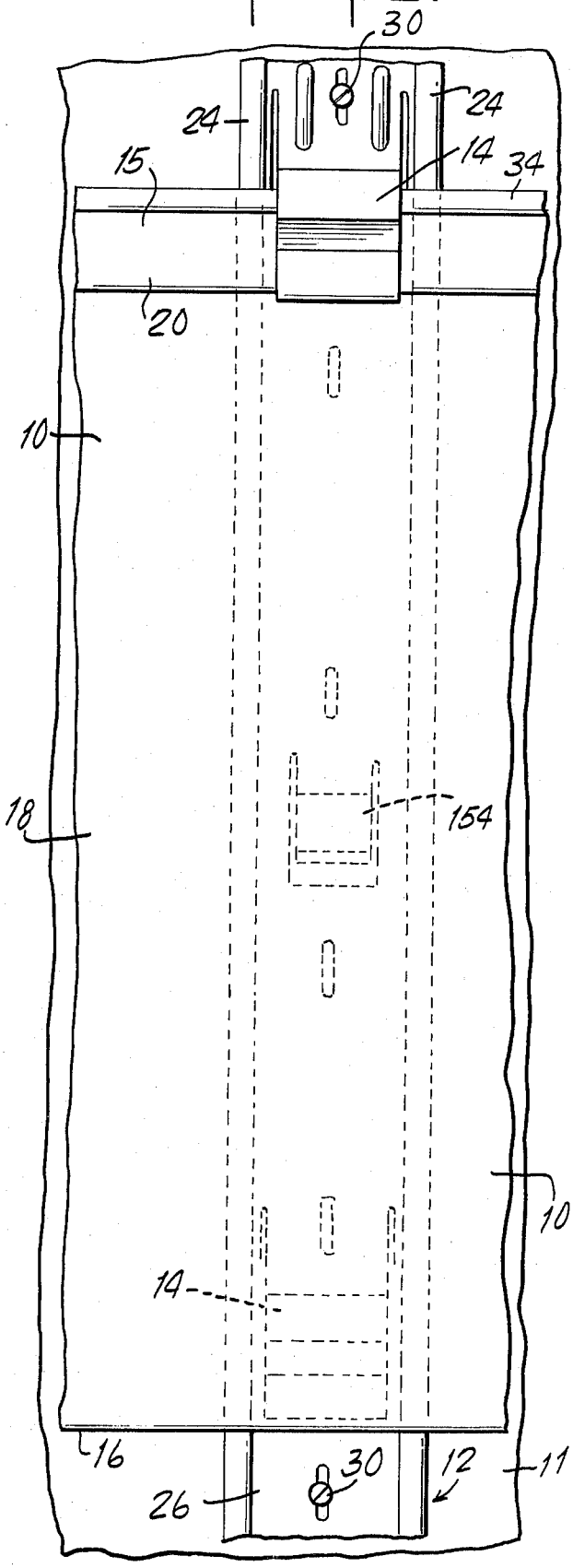
FIG. 1 is a fragmentary front elevational view of a panel and stringer embodying the present invention in a particular form.
Figure 2:
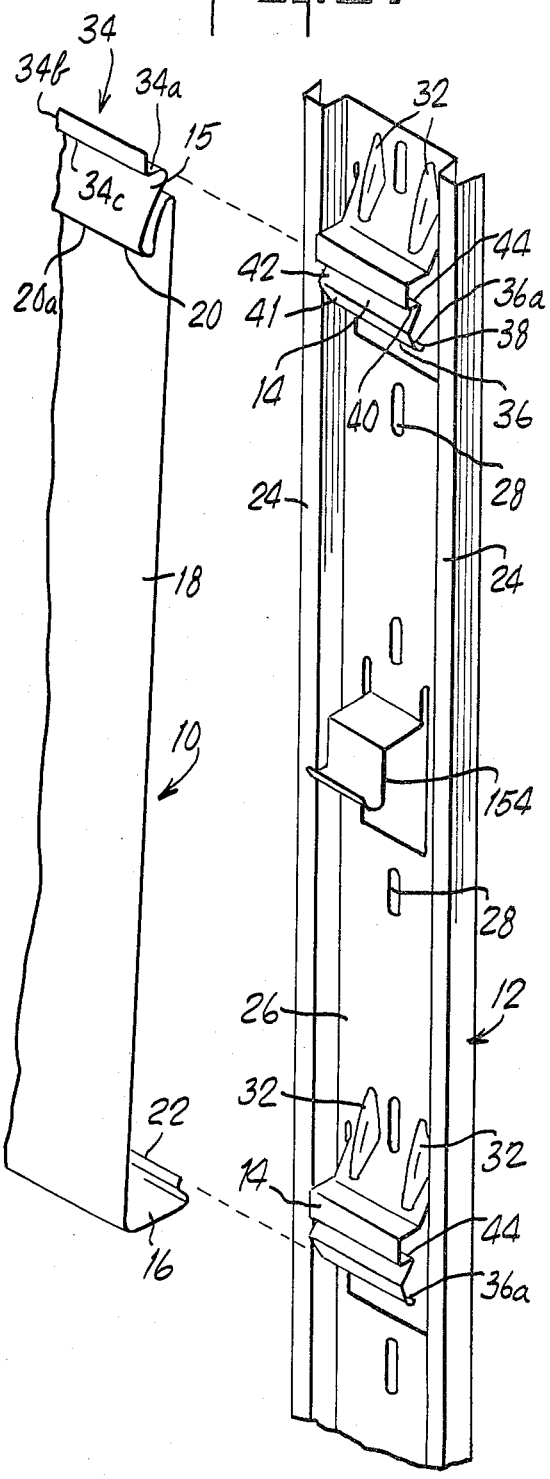
FIG. 2 is a fragmentary exploded perspective view of the panel and stringer of FIG. 1.

Referring first to FIGS. 1–5, the invention is shown as embodied in a siding system comprising an array of interlocked horizontal aluminum panels 10 fastened to a vertical exterior wall 11 by a plurality of vertical stringers 12 each having a plurality of integral, resilient, downwardly opening clips 14.

Each of the panels 10 is roll-formed (e.g. by generally conventional operations) from aluminum strip which has been precoated at least on its outer surface with one or more protective layers of paint, and is a horizontally elongated sheet aluminum article of sufficiently heavy gauge to be self-sustaining in shape, having parallel longitudinal top and bottom margins respectively designated 15 and 16 and a flat continuous central web 18 constituting the major extent of the panel, between the top and bottom margins thereof. At a locality spaced below the top edge of the panel, the top margin 15 is formed with an outwardly and downardly projecting longitudinal lip 20 extending along the full length of the panel. The bottom margin 16 is bent inwardly and then upwardly to form an inwardly projecting, upwardly opening longitudinal channel flange 22 which also extends along the full length of the panel. Typical panel dimensions, as stated, are 12 feet 6 inches in horizontal length and eight inches in exposed vertical height when installed.

Figure 5:
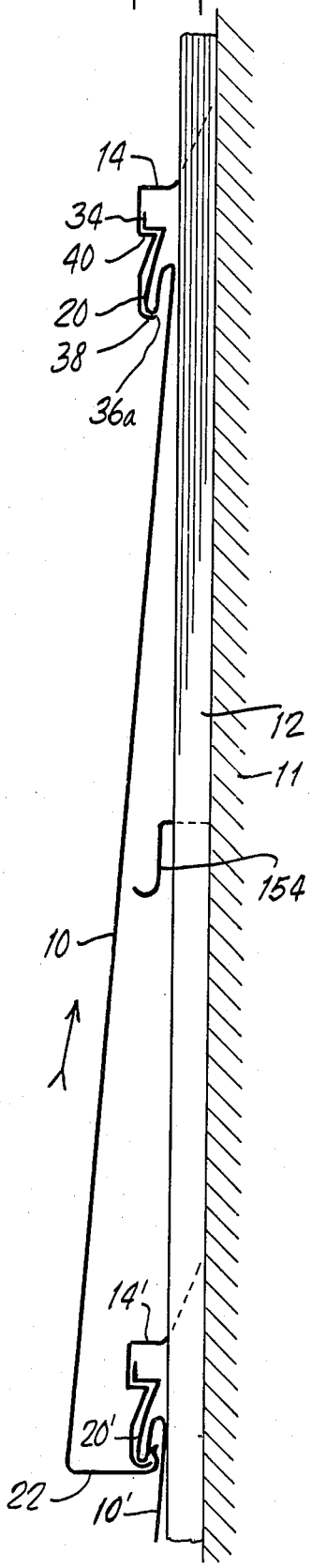

When an array of the panels 10 is mounted on the exterior vertical wall 11, in parallel relation one above another with each panel extending horizontally and with the top margin 15 of each panel secured to the wall by clips 14 of the stringers 12 as hereinafter further described, the channel flange 22 of each panel overlaps and interlocks with the lip 20 of the panel immediately below it, as best seen in FIG. 5; thus each panel is fixedly held, along both top and bottom margins, against displacement. The lower portion of each panel is spaced away from the upper portion of the immediately subjacent panel by the flange 22, so that the web 18 of each panel slopes downwardly and outwardly from the top margin to the bottom margin thereof.

Each of the stringers 12 is a vertically elongated thin metal strip having longitudinal stiffening ribs 24 formed along both side edges and a flat central web 26 punched at intervals along its length to provide holes 28 for nails or screws 30 which secure the strip to the wall 11. At regularly spaced intervals along the length of the stringer, corresponding in number to the number of courses of panels to be installed on the wall, portions of the central web 26 are struck out and formed to provide the downwardly opening clips 14 for receiving and engaging the top margins of the panels. The clips 14 are thus integral with the stringer central web, and are resilient, owing to the inherent resiliency of the sheet metal of which the stringer is made. They are spaced apart vertically on centers along the stringer at distances equal to the distance between the lips 20 of two adjacent (upper and lower) courses of panels in the assembled array, so that when the top margin of one panel is fully engaged by one of the clips, the bottom flange of that panel interlocks in the above-described manner with the lip 20 of the panel held by the next lower clip on the stringer. Pairs of short vertical stiffening ribs 32 (preformed in the web 26 at the positions where the clips are to be struck out) strengthen the localities where the clips bend outwardly from the web. As will be understood, the stringers (including the novel features hereinafter described) may be produced by generally conventional roll-forming, punching, and striking-out operations.

A plurality of the stringers 12, vertically oriented, are mounted side-by-side on the wall 11 (each being fastened to the wall with several screws 30) in spaced parallel relation to each other, e.g. 16 inches or 24 inches apart on centers, with their clips aligned in horizontal rows for receiving the successive courses of horizontal panels. The stringers can be secured, for example, either directly to wall studs or over external wall sheathing. Conveniently, a conventional horizontal starter strip (not shown), as heretofore known in the art for use with horizontal siding systems having vertical stringers, is first mounted on the bottom edge of the wall, and the bottom edges or lowermost clips of the stringers are engaged with this starter strip to align the stringers; the starter strip can be provided with a longitudinal bead for interlocking with the bottom flanges 22 of the lowermost course of panels. When the successive courses of panels 10 (each course comprising one or more panels, depending on the length of the wall) are installed on the stringer clips, each panel is held (at horizontally spaced locations) by a horizontal row of spaced clips respectively formed on a plurality of the stringers; the panels overlie the stringers, being disposed outwardly thereof, and the clips holding the top margin of each panel are concealed by the overlapping bottom margin of the next higher panel.

As thus far described, the siding system of FIGS. 1–5 is generally similar to known assemblies of horizontal siding panels and vertical stringers. The novel features of the present invention embodiment in this system will now be set forth.

The longitudinal top margin 15 of each of the panels 10 includes a portion extending upwardly above the lip 20. In accordance with the invention, in the embodiment of FIGS. 1–5, this marginal portion above the lip 20 is bent horizontally outwardly and then vertically upwardly (e.g. by roll-forming operations which may be in themselves generally conventional) to provide, at the panel top margin above the lip, a longitudinal, outwardly salient locking projection 34 of L-shaped profile integral with and extending for the full length of the panel. As shown, the horizontal base **34*a* of this projection and the leg 34*b* thereof (which extends perpendicularly upward from the outer extremity of tthe base 34*a*) are about equal to each other in width (i.e. transverse horizontal dimension of base 34*a* and transverse vertical dimension of leg 34*b*), the maximum outward extent of the projection 34 being somewhat less than the maximum outward extent of the leg 20. The apex 34*c* of the projection 34 (at the juncture of base 34*a* and leg 34*b*) is spaced (e.g. about half an inch) above the outermost extremity 20*a* of the lip 20**.

In common with clips on conventional stringers, each clip 14 of the stringer 12 extends outwardly and downwardly from the stringer web 26 to terminate, at its lower end, in an inwardly bent extremity 36 providing (on the clip inner surface) a first, generally upwardly facing locking surface or seat 38. The inner edge **36*a* of this extremity 36 is spaced outwardly from a vertical plane tangent to the ribs 24 so as to facilitate insertion of the top marginal portion of a panel under the clip, i.e. between the clip and the last-mentioned ribs. Again as is conventional, when a panel top margin is inserted upwardly as far as possible under the clip, the locking seat 38 closely surrounds the lower extremity 20*a* of the panel lip 20 and is itself surrounded and concealed by the bottom flange 22 of the next higher panel on the wall (FIG. 5**).

Further in accordance with the invention, however, each of the present clips 14 is formed to provide at its inner surface a second generally upwardly facing locking surface or seat 40, spaced above the first locking seat 38 by a vertical distance about equal to (or very slightly greater than) the vertical distance between the lip extremity **20*a* and locking projection 34*c* on a panel 10; and the clip inner surface extends first upwardly (at 41**)

from the outer extremity of seat 38 and then slopes inwardly and upwardly (at 42) to a sharp reverse bend 44 constituting the inner extremity of the second or upper seat 40. Reverse bend 44 is spaced sufficiently outwardly of the aforementioned vertical plane tangent to ribs 24 to facilitate insertion of the panel locking projection 34 therebetween.

Figure 3:
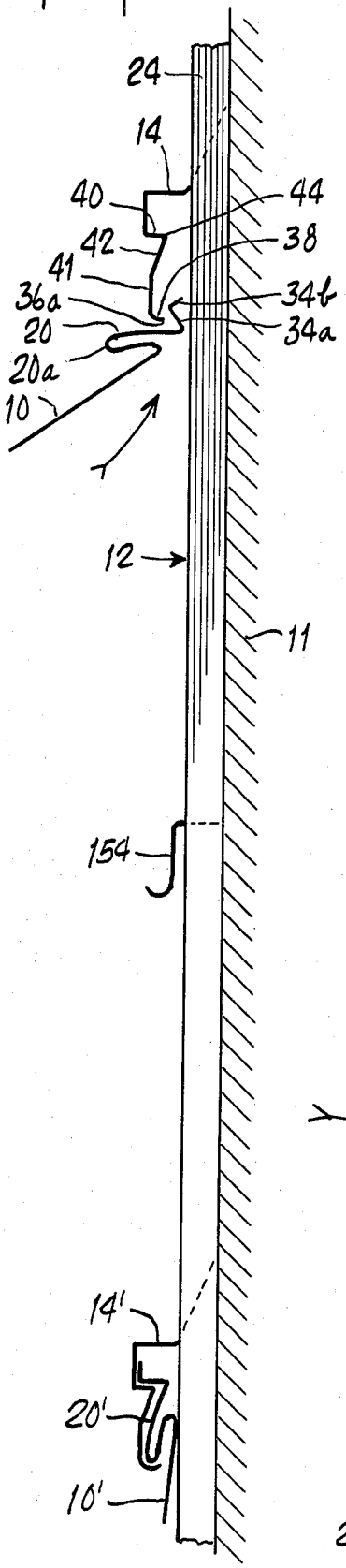
FIGS. 3, 4, and 5 are fragmentary side elevational views illustrating successive steps in mounting a panel on a stringer, in a siding panel system incorporating the FIG. 1 embodiments of panel and stringer.
Figure 4:
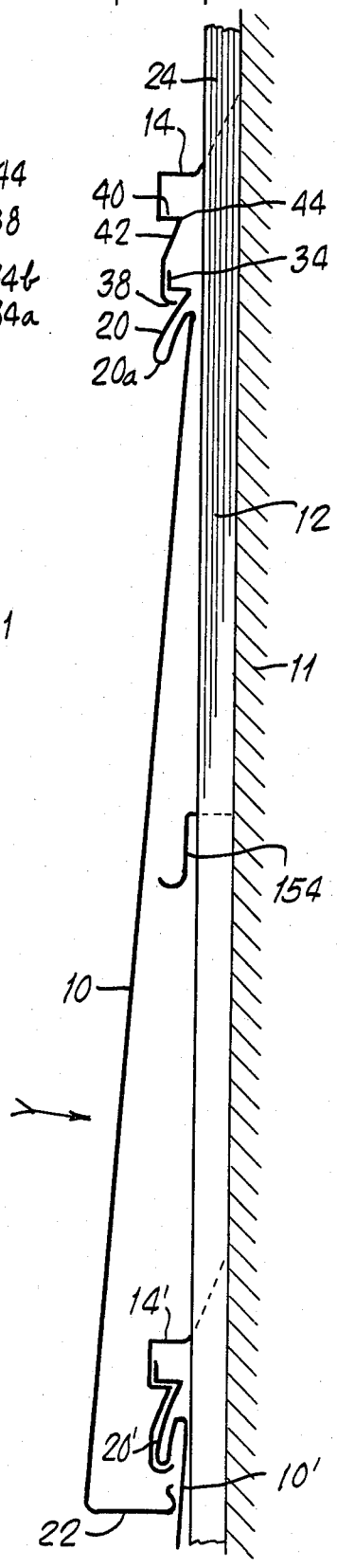

By virtue of the foregoing features of the invention, installation of a panel 10 proceeds as shown in FIGS. 3, 4 and 5, viz.:

With a plurality of the stringers mounted on a wall 11 as already described (and assuming, for convenience of explanation, that a lower course of identical panels 10' has already been installed on the stringers), the top margin 15 of a panel 10 is positioned immediately beneath a horizontal row of the clips 14 while the panel is held upwardly inclined at an angle of about 45° to the horizontal. The panel locking projection 34 is pushed under the lower extremity 36 of each clip in the row (i.e. between the edge 36*a* and the stringer ribs 24) so as to be received in the first or lower locking seat 38 (FIG. 3). The panel is then allowed to swing inwardly and downwardly, pivoting about a horizontal axis substantially coincident with the edges 36*a* of the row of clips, until it hangs downwardly from the clips, being supported by the engagement of its locking projection 34 with the lower locking seats 38 of the clips.

At this position of the panel, as shown in FIG. 4, its bottom locking flange is below and entirely clear of the lip 20' of the next lower panel 10' and the clips 14' surrounding that lip. If for any reason the panel 10 has to be repositioned (for example, if it has somehow failed to engage one or more of the clips 14 which are to hold it), it can readily be removed by a simple reverse (upward and outward) pivotal movement which is continued until the locking projection 34 clears the lower edges 36*a* of the clips, without danger of distortion or other damage to the clips. As will be understood, the locking projection 34 is dimensioned (in relation to the spacing between the clip inner surface and the stringer ribs 24) to permit the described pivotal movement of the panel to be performed in both the inserting and removing directions.

Assuming, however, that the panel in the FIG. 4 position is properly engaged with all the clips, it is pushed vertically upward (by manual pressure of the installer's fingers from below, on the bottom flange 22) from the FIG. 4 position until it reaches the final fully installed position shown in FIG. 5. As it is being thus pushed, the panel projection slides upwardly along the sloping clip surface portion 42, progressively deforming the clip outwardly until the projection 34 passes and clears the reverse bend 44 and is received in the upper seat 40. As soon as projection 34 clears bend 44, the resilient clip snaps back inwardly to lock the projection 34 in the seat 40. The lower seat 38 now closely surrounds the bottom of the panel lip 20, owing to the above-described spacing between the two seats 38 and 40. It will be understood that the normal or unstressed position of bend 44 is sufficiently close to the vertical plane tangent to ribs 24 to ensure that projection 34 will be securely locked in engagement with seat 40 once it enters that seat, and that the sloping configuration of the clip surface portion 42 facilitates the temporary outward deformation of the clip that permits projection 34 to pass bend 44 when the panel is pushed upwardly.

The described upward movement of the panel 10 under finger pressure from the FIG. 4 position to the final (FIG. 5) position also advances the panel bottom flange 22 upwardly toward the lip 20' of the already-mounted next lower panel 10'. As the locking projection enters and is locked into the upper seats 40 of the row of clips, the bottom flange of the panel 10 simultaneously interlocks with the lip 20' of the next lower panel 10', owing to the above-described vertical spacing between adjacent clips on each stringer, so that the fully installed panel is at once fixedly secured along both its top and bottom margins.

This installation procedure, beginning with the lowermost course of panels (the bottom flanges of which interlock with the starter strip, as already mentioned) and continued in sequence with successively higher courses of panels, is repeated until the highest course of panels has been installed.

The attachment of the panels to the wall, afforded by the present invention in its above-described embodiment, is at least equal in security (resistance to dislodgment of the panels by wind loads or impacts) to that provided by conventional panel and vertical stringer systems; and installation of the panels is both much easier, and much less likely to result in damage to the clips, than with conventional systems. In particular, the novel double locking arrangement of the invention enables the installer to engage the clips with a panel prior to (rather than simultaneously with) interlocking of the panel with the next lower panel, thereby reducing the likelihood of failure to properly engage the clips. Moreover, the ability of a panel to be readily pivotally removed from engagement with the clips at its initial, lower (FIG. 4) position facilitates repositioning of a panel when necessary without distorting the clips.

FIGS. 6 and 7 illustrate another embodiment of the invention, again comprising an array of overlapping, interlocking horizontal siding panels and vertical stringers having resilient clips for securing the panels of a wall 11. As shown, the stringers of the siding system of FIGS. 6–7 can be identical to the stringers 12 of FIGS. 1–5; they and their clips are accordingly designated by the same reference numerals as in FIGS. 1–5. The panels 110 of the system of FIGS. 6–7 differ from the panels 10 of FIGS. 1–5 in several particulars, as explained below, but they can be of the same overall dimensions as the panel 10 and have essentially the same top and bottom marginal features for interlocking with each other and for engaging the clips 14 of the stringers 12. Thus, each panel 110 has a top margin 115, a bottom margin 16, and a central web 118. A continuous outwardly and downwardly projecting longitudinal lip 120 extends along the top margin of each panel 110, below the top edge thereof, while the bottom margin bends inwardly and upwardly to provide a continuous longitudinal channel 122 for interlocking with the lip 120 of a subjacent panel, and a longitudinal locking projection 134 of L-shaped profile extends along the top margin above the lip 120; all these features correspond, in position, shape and function, to the lip 20, flange 22, and locking projection 34 of the panel 10 of FIGS. 1–5.

The panel 110 is, however, made of plastic (e.g. vinyl) rather than metal, and is conveniently produced by molding (in a manner conventional for manufacturing plastic panels) rather than by roll-forming, it being understood that all the above-described features of the panel are molded as an integral unit. The central web 118 of a panel 110 is offset inwardly at 148, along its horizontal median, so that each course of panels 110 simulates the appearance of two overlapping courses of narrow clapboards rather than (as in the case of the panels 10 of FIGS. 1–5) a single course of wide clapboards. It will be understood that the central web of a metal panel such as the panel 10 of FIGS. 1–5 can be formed with a corresponding median offset, if desired, this being a known, conventional alternative configuration for horizontal interlocking siding panels, and that the central web 118 of the plastic panel 110 can be a continuous flat monoplanar surface, i.e. without the median offset 148, if desired.

In accordance with the invention in the embodiment represented by FIGS. 6–7, the panel 110 is provided with a second continuous upwardly opening longitudinal channel flange 150, extending inwardly from the inner surface of the web 118 along the horizontal median thereof, and molded integrally with the panel. In the illustrated panel web configuration, the floor of the channel flange 150 is coincident with the inwardly offset portion 148 of the web 118, but if the web is monoplanar (non-offset) the channel floor would be an inward projection from the web inner surface and would not be visible from the outer side of the panel.

The upstanding inner leg 152 of the channel flange 150 is positioned to be inserted under a horizontal row of retaining tabs 154 respectively provided in the plural stringers 12 on which the panel 110 is mounted. The tabs 154 are struck out from the central webs 26 of the stringers 12, and bent downwardly so that each tab defines a downwardly opening gap, between the tab inner surface and the vertical plane tangent to the stringer ribs 24, for receiving the leg 152; the outer extremity of each tab is curved upwardly to guide the leg 152 under the tab. On each stringer 12, one tab 154 is provided between each two vertically adjacent clips 14; thus, when a plurality of the stringers are mounted on a wall, they cooperatively provide a number of horizontal rows of tabs 154 equal to the number of courses of panels to be installed. When (as in FIGS. 1–5) panels 10 having no central channel flange 150 are used, the tabs 154 have no function, but their provision in the stringers enables use of the same stringers with either panels 10 (FIG. 1) or panels 110 (FIG. 6).

Specifically, each tab 154 is so disposed on a stringer 12, in relation to the clips 14, that when the locking projection 134 of a panel 110 is in the lower locking seat 38 of the clip 14 immediately above the tab (i.e. when the panel is in a position corresponding to that shown in FIG. 4), the channel leg 152 of the panel is immediately below and clear of the tab 154; and when the panel is pushed up to the FIG. 7 (fully installed) position, in which the locking projection 134 is received in the upper locking seat 40 of the clip 14 and the bottom flange 120 of the panel is interlocked with the lip 120' of a subjacent panel 110' held in the next lower clip 14', the leg 152 is inserted under the tab 154. Such insertion of the leg 152 under a row of tabs 154 restrains the panel web against outward movement, thereby helping to retain the panel on the stringers and also positionally stabilizing the horizontal median of the web so that abutting ends of adjacent panels in the same course are essentially flush with each other.

It is to be understood that the invention is not limited to the features and embodiments hereinabove specifically set forth, but may be carried out in other ways without departure from its spirit.

We claim:

1. A siding system comprising (a) a plurality of vertically elongated stringers each having a plurality of outwardly projecting and downwardly opening resilient clips spaced at regular intervals along its length, and (b) a plurality of horizontally elongated siding panels each having a top margin with an outwardly and downwardly projecting longitudinal lip extending therealong and a bottom margin bent inwardly and then upwardly to provide an upwardly opening longitudinal channel flange on the inner side of the panel, (c) said stringers being mounted in spaced parallel relation on a wall and so aligned with each other that their respective clips are in horizontal rows, and (d) said panels being disposed in parallel overlapping array, one above another, outwardly of said stringers on said wall, with the top margin of each panel inserted under and held by a horizontal row of the clips and the channel flange of the panel interlocked with the lip of the next lower panel in the array;

wherein the improvement comprises:

(e) each of said panels having a longitudinal locking projection extending along the top margin of the panel and spaced above the lip thereof, and (f) the inner surface of each of said clips defining two vertically spaced inwardly opening locking seats for successively engaging the locking projection of a panel when the panel top margin is inserted progressively upwardly under the clip.

2. A system as defined in claim 1, wherein the lower of the two locking seats of each clip and the locking projection of each panel are mutually shaped and dimensioned for permitting pivotal motion of the panel relative to the cli through a substantial angle when the locking projection is received in said lower locking seat, thereby to facilitate engagement and disengagement of said projection with said lower locking seat.

3. A system as defined in claim 2, wherein the locking projection of each panel is L-shaped in profile with a substantially horizontal base and a substantially vertical leg extending upwardly from the outer extremity of the base.

4. A system as defined in claim 2, wherein the inner surface of each clip above said lower locking seat slopes upwardly and inwardly to the inner extremity of the upper of the two locking seats, for facilitating resilient outward deformation of the clip during upward movement of a panel locking projection from said lower seat to enable insertion of the locking projection into the upper seat.

5. A system as defined in claim 2, wherein the spacing between the two seats of each clip is about equal to the spacing between the locking projection and lip of a panel and wherein the spacing between the respective lower locking seats of two vertically adjacent clips on a stringer is about equal to the spacing between the lips of two vertically adjacent interlocked panels in the array.

6. A system as defined in claim 5, wherein the spacing between the two locking seats of a clip of a stringer is such that when the locking projection of a panel is received in the lower locking seat, the channel flange of the panel is below and clear of the next lower clip of the stringer, and when the locking projection of the panel is received in the upper locking seat, the channel flange of the panel is positioned for interlocking with the lip of a panel held in said next lower clip.

7. A system as defined in claim 1, wherein each of said panels has a horizontally extending and upwardly projecting longitudinal flange connected to and spaced inwardly from the inner surface of the panel at a central locality intermediate the top and bottom margins thereof, and wherein each of said stringers has a plurality of outwardly and downwardly projecting retaining tabs respectively located between the clips of the stringer, each of said tabs being disposed in a position, below one of said clips, for overlying said last-mentioned flange of a panel when the locking projection of the panel is received in the upper of the two locking seats of the last-mentioned clip, to positionally stabilize the horizontal central portion of the panel, the last-mentioned flange being inserted upwardly under the tabe incident to upward movement of the locking projection from the lower to the upper of the clip locking seats.

8. A horizontal siding panel, including (a) a top margin having an outwardly and downwardly projecting longitudinal lip extending therealong;

(b) a bottom margin bent inwardly and then upwardly to provide an upwardly opening longitudinal channel flange, on the inner side of the panel, for interlocking with the lip of an immediately subjacent panel when a plurality of the panels are disposed one above another in overlapping array on a wall;

(c) an outward, longitudinal locking projection extending along and integral with the top margin of said panel at the top edge thereof and spaced above said lip, said locking projection being L-shaped in profile with a substantially horizontal base and a substantially vertical leg extending upwardly from the outer extremity of the base; and (d) a horizontally extending and upwardly projecting longitudinal flange connected to and spaced inwardly from the inner surface of the panel at a central locality intermediate the top and bottom margins thereof.

9. A vertical stringer for securing, to a wall, a plurality of horizontal siding panels disposed one above another in parallel overlapping array, said stringer comprising (a) a vertically elongated strip mountable on a wall and (b) a plurality of outwardly projecting, downwardly opening resilient clips disposed at regularly spaced intervals along the length of the strip for respectively engaging the top margins of successively higher panels of the array to secure the panels to the wall, wherein the improvement comprises (c) the inner surface of each of said clips defining two vertically spaced, inwardly opening locking seats for successively engaging an outwardly projecting portion of the top margin of a panel as the panel top margin is inserted progressively upward under the clip.

10. A stringer as defined in claim 9, wherein the inner surface of each clip, above the lower of the locking seats of the clip, slopes upwardly and inwardly to the inner extremity of the upper of said seats.

11. A stringer as defined in claim 11, further including a plurality of outwardly and downwardly projecting tabs respectively disposed intermediate said clips along the length of said strip.

12. A siding system comprising (a) at least one vertical stringer, mountable on a wall, having a plurality of outwardly projecting and downwardly opening resilient clips spaced at regular intervals along its length, and (b) at least one horizontal siding panel having a top margin engageable with a clip of said stringer for securing the panel to a wall on which the stringer is mounted;

wherein the improvement comprises (c) said one panel having a longitudinal outward locking projection extending along its top margin and (d) each of said clips having two vertically spaced locking seats for successively engaging said locking projecting as said panel top margin is inserted progressively upward under the clip.

13. A system as defined in claim 12, wherein said one panel includes first interlock means for interlocking with another panel disposed above it, and second interlock means for interlocking with the first interlock means of another panel disposed below it, and wherein the spacing between the two seats on each of said clips and the spacing of adjacent clips on said stringer are such that when the top margin of said one panel is inserted under one of said clips, the second interlock means of said one panel does not interlock with the first interlock means of another panel engaged by the next lower clip until the locking projection of said one panel is received in the upper of the two locking seats of said one clip.

* * * * *